United States Patent [19]

Asano et al.

[11] 4,221,191

[45] Sep. 9, 1980

[54] ELECTRONIC FUEL INJECTION WITH MEANS FOR PREVENTING FUEL CUT-OFF DURING TRANSMISSION GEAR CHANGES

[75] Inventors: Masaharu Asano, Yokosuka; Shigeo Aono, Seki, both of Japan

[73] Assignee: Nissan Motor Company, Limited, Yokohama City, Japan

[21] Appl. No.: 815,056

[22] Filed: Jul. 12, 1977

[30] Foreign Application Priority Data

Jul. 13, 1976 [JP] Japan ..... 51-82566

[51] Int. Cl.[2] ..... F02B 3/00

[52] U.S. Cl. ..... 123/492; 123/493

[58] Field of Search ..... 74/861, 857, 858, 860; 123/32 EH, 32 EL, 32 EA, 117 A

[56] References Cited

U.S. PATENT DOCUMENTS

| | | | |
|---|---|---|---|
| 3,703,162 | 11/1972 | Aono | 123/32 EL |
| 3,759,131 | 9/1973 | Endo | 123/32 EH |
| 3,763,720 | 10/1973 | Aono et al. | 123/32 EA |
| 3,776,205 | 12/1973 | Maruoka | 123/117 A |
| 3,792,630 | 2/1974 | Hanse | 123/117 A |
| 3,926,153 | 12/1975 | Reddy | 123/32 EL |
| 4,062,328 | 12/1977 | Konno | 123/32 EL |
| 4,092,961 | 6/1978 | Tomada | 123/119 EC |
| 4,121,545 | 10/1978 | Mizole | 123/32 EA |

FOREIGN PATENT DOCUMENTS

| | | | |
|---|---|---|---|
| 965508 | 4/1975 | Canada | 123/32 EH |
| 2602989 | 8/1978 | Fed. Rep. of Germany | 123/32 EH |
| 2822229 | 12/1978 | Fed. Rep. of Germany | 123/32 EH |

*Primary Examiner*—Charles J. Myhre
*Assistant Examiner*—Raymond A. Nelli

[57] ABSTRACT

In an electronic fuel injection system for an internal combustion engine, a throttle position sensor provides an output pulse with a duration corresponding to the time interval during which throttle is nearly closed. The output from the throttle position sensor is nullified when the pulse duration is smaller than a predetermined value to prevent fuel cut-off during brief closure of throttle during transmission gear changes. The output from the throttle position sensor is used to cut off fuel only when the throttle closure time extends beyond the predetermined time interval.

5 Claims, 5 Drawing Figures

ELECTRONIC FUEL INJECTION WITH MEANS FOR PREVENTING FUEL CUT-OFF DURING TRANSMISSION GEAR CHANGES

BACKGROUND OF THE INVENTION

The present invention relates to electronic fuel injection for internal combustion engines.

In electronic fuel injection various engine operating parameters are sensed to give information on engine input and output conditions to an electronic control unit where the sensed variables are processed to optimize the fuel quantity delivered to each cylinder. To decelerate an engine, fuel is conventionally cut off by sensing the throttle being nearly closed while the engine speed is above a predetermined level. Although this fuel cut-off feature is advantageous in terms of exhaust emissions and driveability during deceleration, it is disadvantageous when the driver attempts to accelerate the engine by changing transmission gear ratios while operating the clutch to momentarily disengage the engine from transmission, since during these operations throttle is nearly closed to cut off fuel briefly so that mixture is leaned while the engine requires enrichment. This introduces a rapid change in air fuel ratio resulting in the production of a substantial amount of noxious emissions and a momentary loss of engine power. Particularly, for a closed-loop fuel control system using a feedback signal derived from an exhaust gas sensor, the introduction of such a rapid change in air-fuel ratio will cause the system to oscillate abnormally. This problem may find its solution in the use of a conventional dashpot type throttle in which the movement of the throttle as it approaches the nearly closed position is damped. However, the damping operation results in poor driveability due to partial loss of engine brake and an increase in cost for additional mechanical components.

SUMMARY OF THE INVENTION

An object of the invention is to provide an improved electronic fuel injection system wherein fuel is cut off by a signal indicating closed throttle position and in which there is employed a signal absorbing circuit which is insensitive to such a signal of a short duration but responsive to a longer duration signal by generating an output, this output being used to cut off fuel supply when the vehicle is actually decelerated.

BRIEF DESCRIPTION OF THE DRAWINGS

These and other objects and advantages of the invention will be understood from the following description taken in conjunction with the accompanying drawings, in which.

DESCRIPTION OF THE PREFERRED EMBODIMENTS

Figure 1:
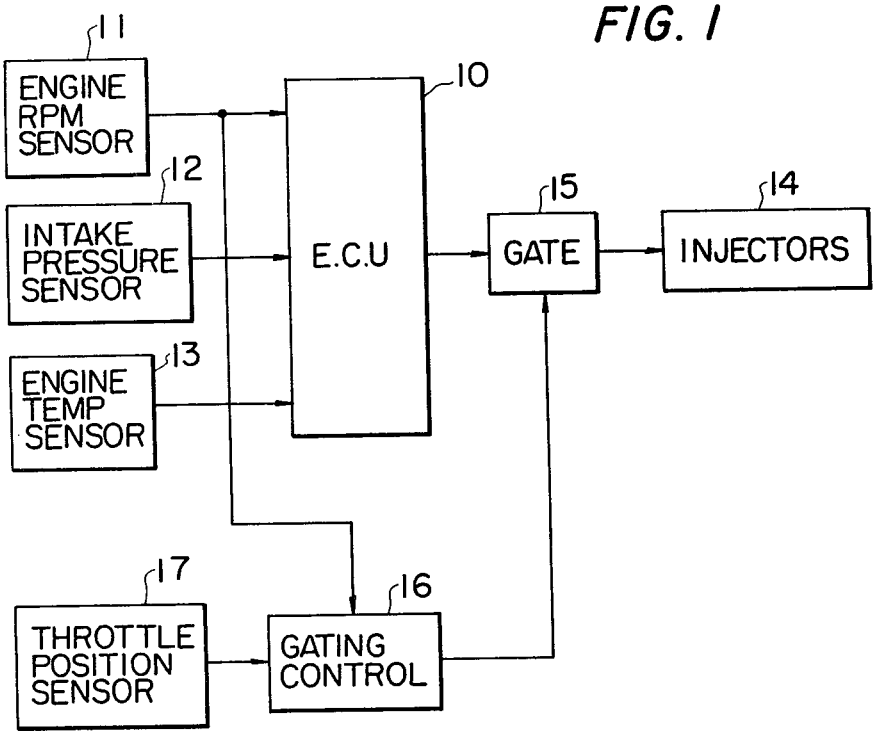
FIG. 1 is a schematic function block diagram of an embodiment of the invention.

Referring now to FIG. 1, a schematic circuit diagram of an electronic fuel injection embodying the invention is illustrated. An electronic control unit (ECU) 10 is shown as a functional circuit block and the description thereof is not necessary because its primary function is well known in the art. Specifically, it receives sensed engine parameters from an engine rpm sensor 11, air flow sensor 12, and engine temperature sensor 13 to deliver pulses with a duration which varies a function of the continuously measured engine parameters. The pulses delivered from the control unit 10 are fed to fuel injectors 14 through an inhibit gate 15 which is under the control of the output from a gating control circuit 16. The gating control 16 receives its input signals from the engine rpm sensor 11 and a throttle position sensor 17 to generate an output when throttle is nearly closed and engine rpm is above the predetermined value.

Figure 2:
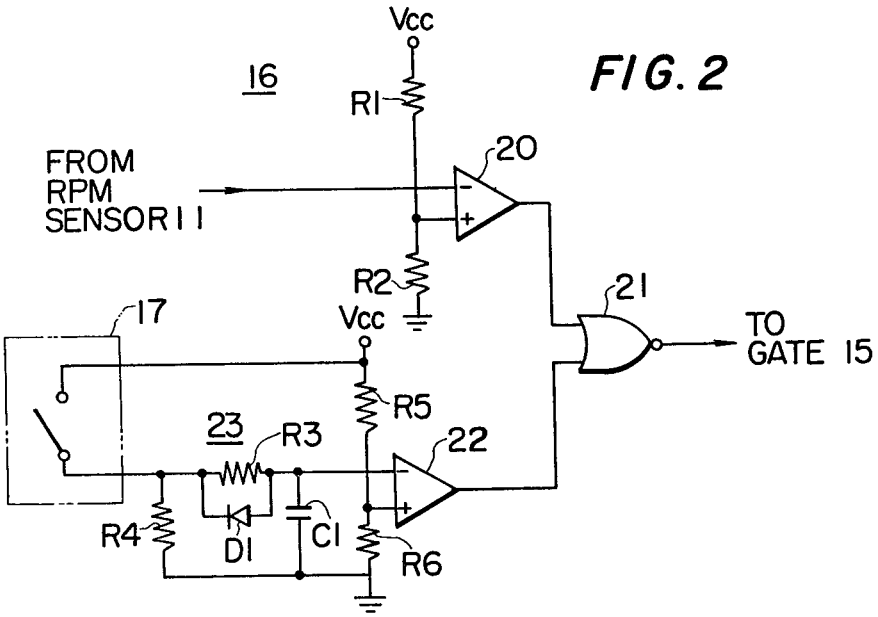
FIG. 2 is a detailed circuit of a gating control circuit of FIG. 1.

As illustrated in FIG. 2, the gating control circuit 16 includes a comparator 20 having its inverting input connected to the output of engine rpm sensor 11 and its noninverting input connected to a fixed reference provided from the junction of resistors R1 and R2, the output of this comparator being connected to an input of a two-level NOR gate 21. The comparator 20 generates a low voltage output when the engine rpm is above a predetermined value represented by the fixed voltage reference. The gating control circuit 16 further includes a pluse absorbing circuit which is insensitive to a short duration input pulse but responds to a longer duration input by generating a delayed output. The absorbing circuit is formed by a comparator 22 and a charge-discharge circuit 23 including a capacitor C1 which is charged via resistor R3 and discharged via a diode D1 and a resistor R4. The throttle position sensor or switch 17 is provided which is operable to close when throttle is substantially closed for deceleration. The closure of throttle switch 17 draws a current from voltage supply source Vcc through resistor R3 and capacitor C1 to ground and develops a time-varying voltage across the capacitor C1. This voltage is applied as an input to the inverting input of the comparator 22 for comparison with a fixed reference applied to its non-inverting input from resistors R5 and R6. The voltage across capacitor C1 rises at a rate determined by the time constant R3C1 and when the fixed reference is reached the comparator 22 provides a low voltage level output to the other input of the NOR gate 21.

It is assumed that accelerator pedal is released momentarily during time interval $t_1$ to $t_2$ as illustrated in FIG. **4*b* when the driver attempts to change shift gear position to neutral for acceleration while disengaging the clutch. The time constant value R3C1 and the comparator 22 threshold are so selected that the voltage across capacitor C1 does not reach the fixed reference during the interval $t_1$ to $t_2$ so that comparator 22 does not respond to short duration outputs from the throttle position sensor 17. Resistor R4 is selected at a value smaller than resistor R3 so that upon the opening of the throttle position switch 17 at time $t_2$ capacitor C1 is discharged through diode D1 and resistor R4 at a higher rate than capacitor C1** is charged.

Figure 4:
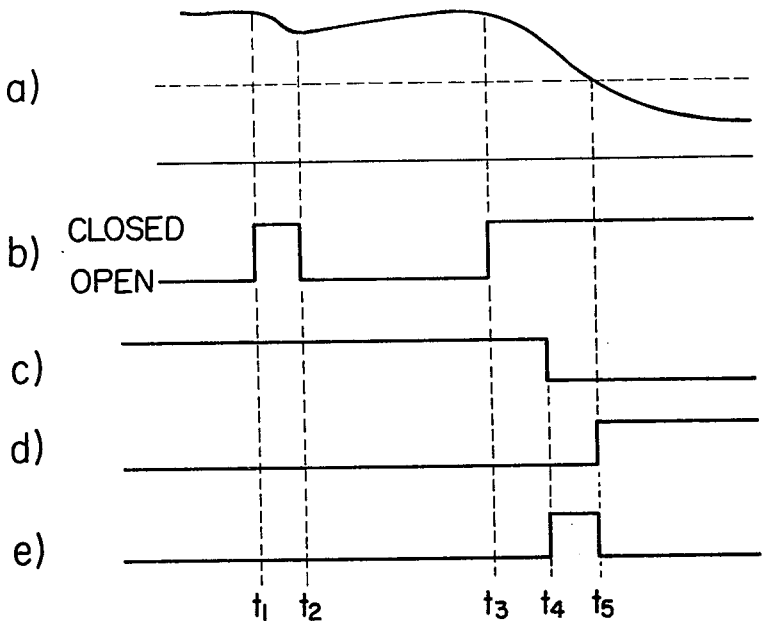
FIG. 4 is a series of waveforms useful for describing the operation of FIG. 2.

During deceleration operation commencing at time $t_3$ onward, the throttle position sensor 17 closes its contact at time $t_3$ (FIGS. **4*a*, 4*b*). The comparator 22 introduces a delay time and responds to the contact closure by driving its output to the low voltage level at time $t_4$, as illustrated in FIG. 4*c*. As the engine rpm decreases below the fixed reference at time $t_5$, the comparator 20 provides a high voltage output so that during time interval $t_4$ to $t_5$ the output from NOR gate 21** is at high voltage level as shown in FIG. 4*e* and prevents the injection pulses from controller unit 10 from passing through the inhibit gate 15.

Therefore, it is understood that the release of accelerator pedal for a short duration of time when the shift lever is being changed during engine acceleration permits the injection pulses to be passed through inhibit gate 15, and when the engine deceleration is actually commenced the injection pulses are disabled until the engine rpm decreases below the present value.

Figure 3:
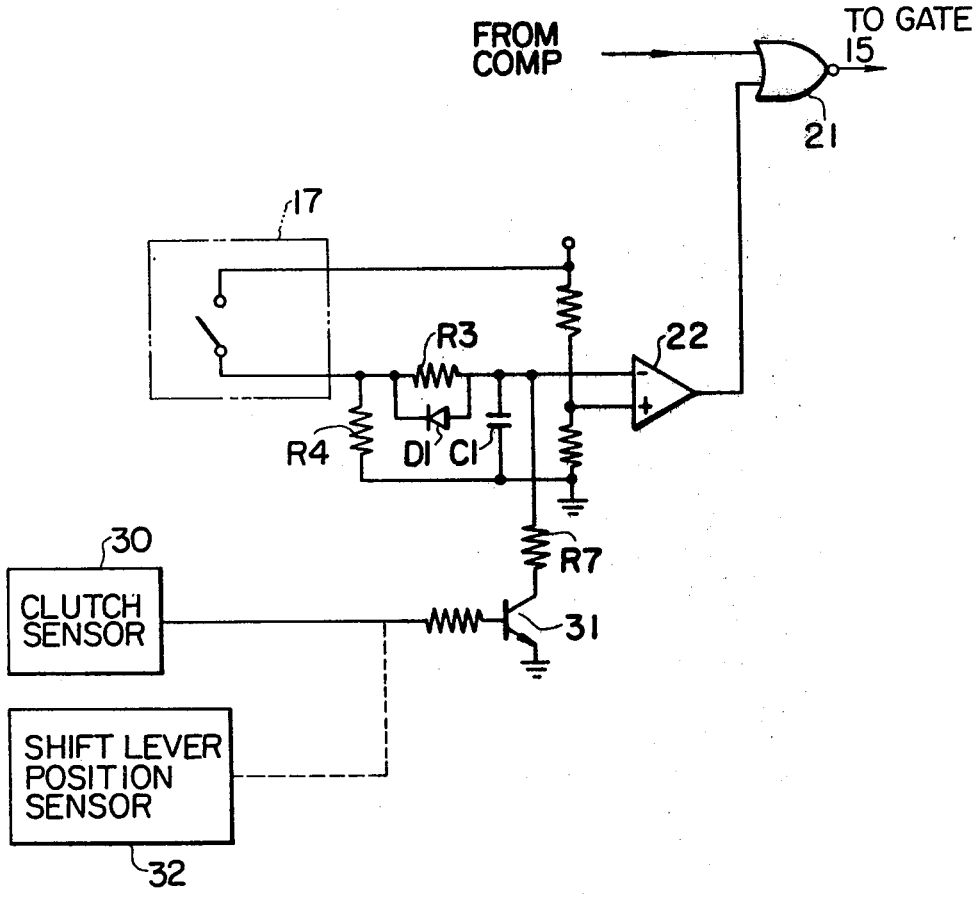
FIG. 3 is a modification of the embodiment of FIG. 1.

FIG. 3 illustrates a modification of the previous embodiment in which a clutch sensor 30 is provided to detect when the clutch is operated to disengage the engine from transmission. The output from the clutch sensor 30 is connected to the base of a transistor 31 whose emitter is connected to ground and whose collector is connected to the inverting input of the comparator 22 via resistor R7. The transistor 31, which is normally biased off, is rendered conductive in response to the output from the clutch sensor 30 so that capacitor C1 is short-circuited.

Figure 5:
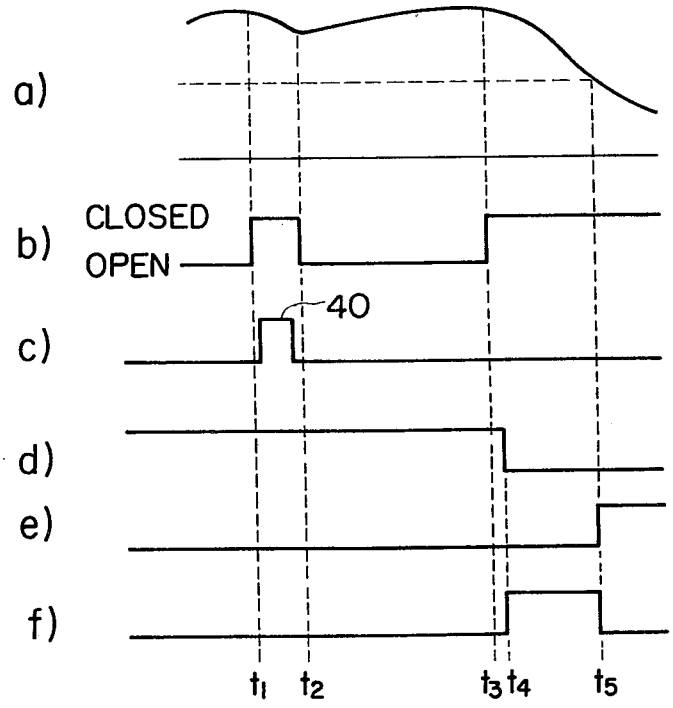
FIG. 5 is a series of waveforms useful for describing the operation of FIG. 3.

The operation of the circuit of FIG. 3 is generally similar to that described in connection with the circuit of FIG. 2 except that within the time interval $t_1$ to $t_2$ the clutch sensor 30 generates a pulse 40 as shown in FIG. 5*c*. Since the capacitor C1 is short-circuited by the transistor 31, it is possible to provide a smaller value of time constant R3C1 than that of the previous embodiment so that comparator 22 can quickly respond to the output from the throttle sensor 17 at $t_4'$ as shown in FIG. 5*f*.

It is to be noted that the clutch sensor 30 can be replaced with a shift lever position sensor 32 which generates its output when the shift lever is in neutral position.

What is claimed is:

1. An electronic fuel injection system for an internal combustion engine mounted in a vehicle having a clutch for coupling the engine power to a drive shaft of the vehicle, a throttle valve in an air intake passage of the engine, a control unit responsive to an engine operating parameter for determining the duration of fuel injection for each working cycle of the cylinders of the engine, a throttle position sensor for generating throttle position signal when said throttle valve is nearly closed, means for generating an engine speed signal when the revolution of said engine per unit time is above a predetermined value, and means for inhibiting the injection of fuel in response to the simultaneous presence of said throttle position signal and said engine speed signal, comprising:

means for disabling said throttle position signal when said throttle position signal has a duration smaller than a predetermined period of time which is substantially equal to the period in which said throttle valve is nearly closed when said clutch is momentarily decoupled for acceleration and enabling said throttle position signal when the duration of said throttle position signal is greater than said predetermined period of time.

2. An electronic fuel injection system as claimed in claim 1, wherein said disabling and enabling means comprises an RC timing circuit operable to generate a time-varying voltage across the capacitor of the circuit in the presence of said throttle position signal and a comparator responsive to the time-varying voltage for comparison with a fixed reference for disabling said throttle position signal when said time-varying signal is below said fixed reference and enabling said throttle position signal when said time-varying signal is above said fixed reference.

3. An electronic fuel injection system as claimed in claim 2, wherein said RC timing circuit comprises a first resistor connected at one end to said throttle position sensor and at the other end to said comparator, a diode connected in parallel with the first resistor, a second resistor connected at one end to an end of said first resistor and at the other end to ground, said capacitor being connected between the other end of said first resistor and ground, the resistance value of said second resistor being smaller than that of said first resistor and said diode being poled such that the direction of current therethrough is from said capacitor toward said sensor resistor.

4. An electronic fuel injection system as claimed in claim 2, further comprising a clutch sensor for detecting when said clutch is decoupled and means for providing a short-circuit path across said capacitor in response to said clutch sensor.

5. An electronic fuel injection system as claimed in claim 2, further comprising a shift lever position sensor for detecting when the shift lever of the vehicle is in neutral position and means for providing a shortcircuit path across said capacitor in response to said shift lever position sensor.

* * * * *